United States Patent [19]

Röck et al.

[11] 4,112,543

[45] Sep. 12, 1978

[54] FURNITURE HINGE

[75] Inventors: Erich Röck, Höchst; Bernhard Mages, Dornbirn, both of Austria

[73] Assignee: Julius Blum Gesellschaft M.B.H., Höchst, Austria

[21] Appl. No.: 803,305

[22] Filed: Jun. 3, 1977

[30] Foreign Application Priority Data

Jun. 4, 1976 [AT] Austria ..... 4102/76

[51] Int. Cl.[2] ..... E05D 3/06; E05D 11/10; E05F 1/12

[52] U.S. Cl. ..... 16/164; 16/145

[58] Field of Search ..... 16/163, 164, 165, 145, 16/183, 50

[56] References Cited

U.S. PATENT DOCUMENTS 3,744,086 7/1973 Salice ..... 16/164

FOREIGN PATENT DOCUMENTS 2,432,828 1/1975 Fed. Rep. of Germany ..... 16/50
2,439,314 2/1976 Fed. Rep. of Germany ..... 16/145
2,536,744 6/1976 Fed. Rep. of Germany ..... 16/145
2,616,570 1/1977 Fed. Rep. of Germany ..... 16/164

*Primary Examiner*—James Kee Chi
*Attorney, Agent, or Firm*—Wenderoth, Lind & Ponack

[57] ABSTRACT

A furniture hinge comprises a hinge casing and a hinge arm, each adapted to be mounted on different furniture parts and connected by means of hinge links, a pressure spring acting on one hinge link, and a guiding lever interpositioned between the spring and such one hinge link.

5 Claims, 6 Drawing Figures

FURNITURE HINGE

BACKGROUND OF THE INVENTION

1. Field of the Invention

The invention relates to a hinge, particularly for furniture doors, having a hinge arm which is connected with a second hinge part, e.g. a hinge casing, by means of hinge links forming a link quadrangle whereby one hinge link is provided with a curved part which has a guiding edge which acts on or controls a spring, for example a leg spring, which is preferably mounted on an axle of a hinge link.

2. Description of the Prior Art

Hinges whose hinge axles and hinge links are arranged in the above-mentioned way have more and more frequently been used for furniture doors whereby one hinge part usually has the shape of a casing which can be inserted into a recess of the furniture door and whereby the second hinge part is a hinge arm which can be mounted and preferably be adjusted on the side wall inside the piece of furniture.

By providing hinges of the above-mentioned kind with springs, a closing pressure is exerted on the door when the hinge is closed. Such hinges are not however always satisfactory, especially because of the great strain on some parts of the hinge over an excessively long period. The life of these hinges is, therefore, relatively short.

It is a further disadvantage of many hinges according to the prior art that the closing pressure is exerted in any position the door is in, which means also, if the door is completely open.

SUMMARY OF THE INVENTION

Therefore, one demand which is made regarding the above-mentioned hinges is that the closing pressure is only exerted when the door is closed, or almost closed so that doors which are not completely closed will be closed automatically by the hinge. The door is considered as almost closed if there is an angle of approximately 10°–15° between the actual door position and the plane of the closed door.

It is the object of the present invention to produce a hinge of the above-mentioned kind which distinguishes exactly between positions where closing pressure is exerted and others where it is not, and which makes it possible to alter the dividing line between these positions by mounting exchangeable parts according to particular requirements.

According to the invention, this object is achieved by placing a pressure lever, e.g. a guiding lever, between the spring and the curved part, whereby the guiding lever includes two pressure sections which are positioned at an angle to each other and which rest alternatively on the guiding edge of the curved part.

A preferred embodiment of the invention provides that at least one pressure section of the guiding lever has a curved surface whose curvature is the same as the curvature of a section of the guiding edge of the curved part, whereby the curved section of the guiding lever is preferably concave, whereas the corresponding section of the guiding edge of the curved part is convex.

This embodiment allows close contact and smooth gliding between the curved part and the guiding lever when the door is opened or being opened. Furthermore, the force is transferred from the spring onto the guiding edge of the curved part in such a way that the force is transferred onto a big area of the curved part, which is of special advantage when using a curved part made of plastics material.

The advantage of a part made of plastics is on the one hand its ease of production and on the other hand the especially favourable coefficient of friction between the curved part and the guiding lever particularly if the guiding lever is made of metal, e.g. zinc die cast.

A further embodiment of the invention provides that the curved part is mounted in bearings on an axle of a hinge link. This embodiment provides an especially good support for the curved part.

BRIEF DESCRIPTION OF THE DRAWINGS

In the following an embodiment of the invention will be described in detail by means of the attached drawings, wherein.

DESCRIPTION OF THE PREFERRED EMBODIMENT

Figure 1:
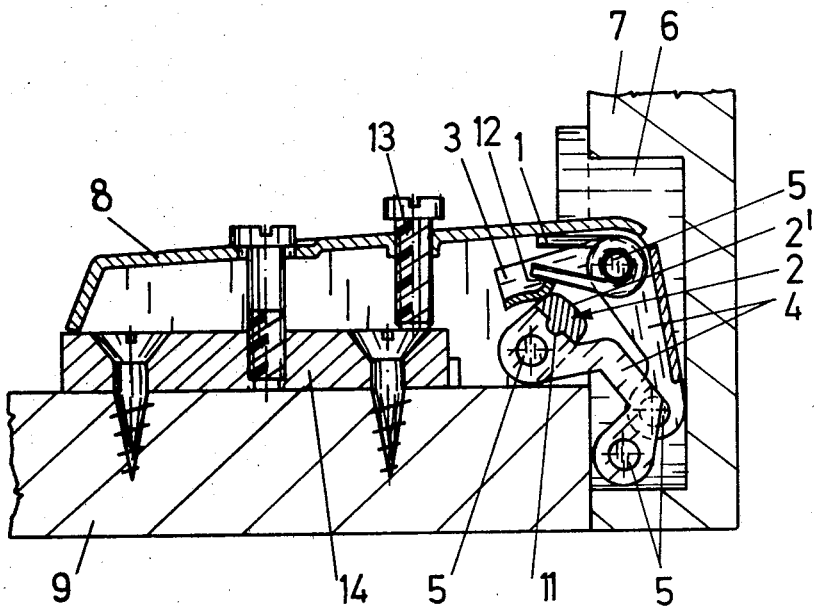
FIG. 1 shows a section of a hinge according to the invention in the closed position.

The hinge according to the illustrated embodiment includes a hinge part such as a hinge casing 6 which is to be inserted into a recess of the door 7. The other hinge part has a hinge arm 8 which is fastened to the side wall 9 of the piece of furniture. Two hinge axles 5 are mounted on the hinge casing 6 and two further hinge axles 5 on the hinge arm 8. The hinge axles 5 are connected with each other by hinge links 4.

As can be seen in the drawings, a curved part or member 2 is mounted on one hinge link 4, i.e. on the lower or inner hinge link 4. The curved part 2 is made of plastics and is located at a position above the hinge axle 5 which connects the hinge link 4 with the lower hinge arm 8.

Figure 2:
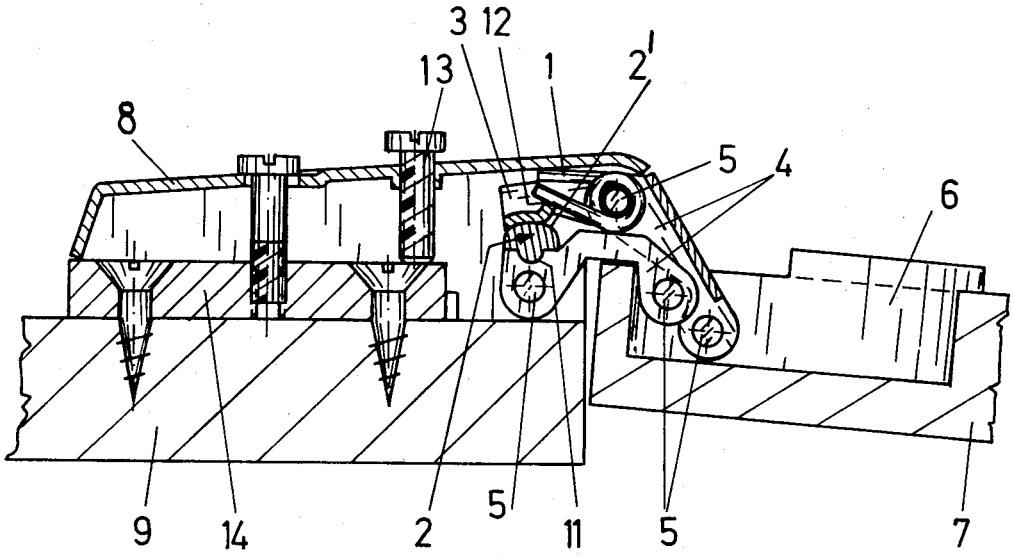
FIG. 2 shows a section of a hinge according to the invention in the opened position.
Figure 3:
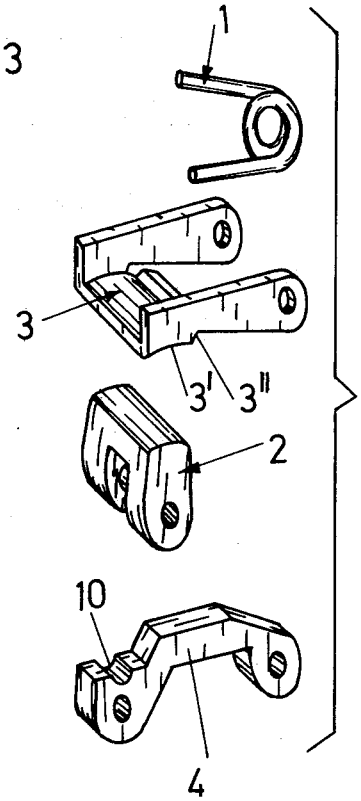
FIG. 3 illustrates the separate parts belonging to the closing device.

As can be seen in FIGS. 1 to 3, the lower hinge link 4 has a recess or groove 10 into which a rib or projection 11 of the curved part 2 engages when the curved part 2 has been mounted. In this embodiment the position of the curved part 2 with respect to the lawn hinge link 4 remains unchangeable when the hinge is in use.

The curved part 2 essentially forms a two-arm lever with the hinge link 4, whereby the two lever arms are positioned at an angle to each other.

Furthermore, on the hinge arm 8 there is mounted a spring 1 which, in the embodiment shown, is a leg spring. This spring 1 is mounted on an axle 5 of the hinge link 4 which does not have a curved part 2, i.e. the outer hinge link.

On the same axle 5 of the hinge link, there is pivotally mounted a guiding lever 3, such that the spring 1 rests with one leg thereof directly on the hinge arm 8 and with the second leg thereof on a stop 12 of the guiding lever 3. The guiding lever 3 is provided with two pressure sections 3', 3'' which are positioned at an angle to each other.

Figure 4:
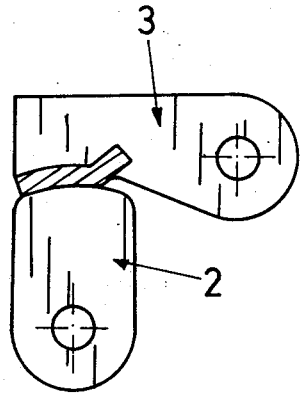
FIG. 4 shows a side view of the curved part and the guiding lever when the door is in the opened position.

As can be seen in FIGS. 2 and 4 the pressure section 3′ is slightly curved and exerts a radial pressure directly on the curved part 2 when the door 7 is being opened without exerting a torque on the hinge link.

Figure 5:
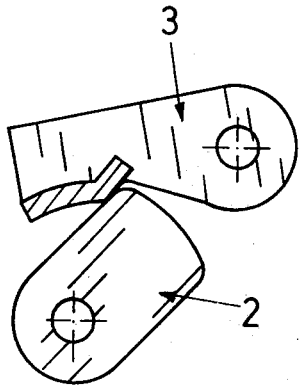
FIG. 5 shows a side view of the curved part and of the guiding lever when the door is in the closed position.
Figure 6:
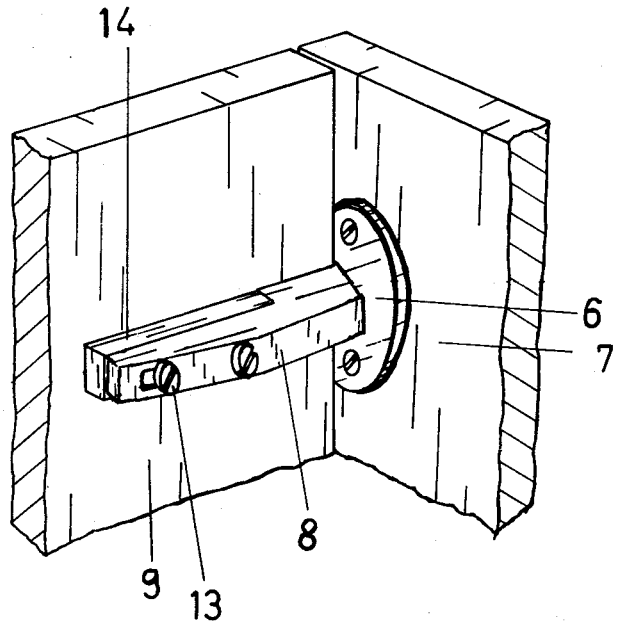
FIG. 6 shows a hinge according to the invention when mounted on the furniture parts.

When the door 7 is closed the guiding lever 3 presses with its pressure section 3″ on the side of the curved part 2 so that in this position a torque is exerted on the hinge link 4, which keeps the door 7 closed, as can be seen in FIGS. 1 and 5.

The various positions of the curved part 2 on the one hand and of the guiding lever 3 on the other hand, when the door 7 is being closed and opened, are separately illustrated in FIGS. 4 and 5, whereby FIG. 4 shows the position when the door 7 is open, and FIG. 5 shows the position when the door 7 is closed.

It can be especially seen in these drawings that by a careful choice and adjustment of the curved surfaces which touch one another firstly on the curved part 2 and secondly on the guiding lever 3, the exact beginning, the duration and the end of the closing process can be chosen.

In the embodiment shown the hinge arm 8 is fixed on a mounting plate 14 by means of adjustment screw 13 and on the side wall 9 of the piece of furniture by means of the mounting plate 14.

This way of fastening, however, and the possibility of adjusting the hinge arm with respect to the mounting plate 14 will not be described in detail as these features are not the object of the invention. This is also true for the particular construction of the hinge links 4, the cross-section of which can for example be U-shaped in profile.

We claim:

1. A hinge, particularly for use in hingedly connecting a furniture door to an article of furniture, said hinge comprising:

a hinge arm adapted to be connected to an article of furniture;

a casing adapted to be connected to a furniture door;

a first, inner hinge link having first and second opposite ends, said first end of said inner link being pivotally connected to said hinge arm by a first axle, and said second end of said inner link being pivotally connected to said casing by a second axle;

a second, outer hinge link having first and second opposite ends, said first end of said outer link being pivotally connected to said hinge arm by a third axle, and said second end of said outer link being pivotally connected to said casing by a fourth axle;

said inner and outer links cooperating to form a quadrangular linkage connecting said casing to said hinge arm, such that said casing is movable about said quadrangular linkage between an open first position and a closed second position;

an element formed of plastic material and having a curved guiding edge, said element being fixedly positioned on said inner link at a position thereon adjacent the pivotal connection of said first end thereof about said first axle to said hinge arm, with said curved guiding edge facing outwardly away from said first axle, said element having a side surface facing laterally away from said curved guiding edge;

a metal guiding lever pivotally connected to said third axle, said guiding lever having thereon first and second pressure sections which extend at an angle to each other, said first pressure section contacting said curved guiding edge of said element when said casing is at or moving toward said open first position thereof, and said second pressure section contacting said side surface of said element when said casing is at or closely adjacent said closed second position thereof; and spring means for urging said guiding lever toward said element, such that when said casing is at or moving toward said open first position thereof said spring means and said first pressure section produce no torque urging said inner link about said first axle, and such that when said casing is at or closely adjacent said closed second position thereof said spring means and said second pressure section produce a torque urging said inner link about said first axle in a direction tending to urge said casing toward said closed second position thereof.

2. A hinge as claimed in claim 1, wherein said first pressure section comprises a curved surface having a curvature complementary to the curvature of said curved guiding edge of said element.

3. A hinge as claimed in claim 2, wherein said curved surface of said first pressure section is concave, and said curved guiding edge of said element is convex.

4. A hinge as claimed in claim 1, wherein said spring means is mounted about said third axle.

5. A hinge as claimed in claim 4, wherein said spring means comprises a torsion spring having a first leg contacting said hinge arm and a second leg contacting said guiding lever.

* * * * *